US006418825B1

(12) United States Patent
Hartmann

(10) Patent No.: US 6,418,825 B1
(45) Date of Patent: Jul. 16, 2002

(54) DEVICE FOR CUTTING A PAPER WEB IN THE TRANSVERSE DIRECTION

(75) Inventor: Otto Hartmann, Zusmarshausen (DE)

(73) Assignee: Boewe Systec AG, Augsburg (DE)

( * ) Notice: Subject to any disclaimer, the term of this patent is extended or adjusted under 35 U.S.C. 154(b) by 0 days.

(21) Appl. No.: 09/530,718

(22) PCT Filed: Oct. 13, 1998

(86) PCT No.: PCT/DE98/03060

§ 371 (c)(1),
(2), (4) Date: May 2, 2000

(87) PCT Pub. No.: WO99/24343

PCT Pub. Date: May 20, 1999

(30) Foreign Application Priority Data

Nov. 5, 1997 (DE) ..... 197 48 789

(51) Int. Cl.[7] ..... B26D 5/20; B65H 35/04
(52) U.S. Cl. ..... 83/110; 83/236; 83/262
(58) Field of Search ..... 83/262, 110, 236, 83/257, 261

(56) References Cited

U.S. PATENT DOCUMENTS

| | | | | | |
|---|---|---|---|---|---|
| 2,655,842 | A | * | 10/1953 | Baumgartner | 225/96 |
| 3,639,053 | A | * | 2/1972 | Spear, Jr. | 83/110 |
| 3,728,920 | A | * | 4/1973 | Gardner et al. | 83/262 |
| 3,768,349 | A | * | 10/1973 | Cauffiel | 83/236 |
| 3,882,744 | A | * | 5/1975 | McCarroll | 83/262 |
| 4,149,484 | A | * | 4/1979 | Koch | 118/42 |
| 4,340,441 | A | * | 7/1982 | Thwaites et al. | 83/261 |
| 4,353,274 | A | * | 10/1982 | Shimizu | 83/156 |
| 4,429,602 | A | * | 2/1984 | Vits | 83/110 |
| 4,699,031 | A | * | 10/1987 | D'Angelo et al. | 83/23 |
| 4,860,619 | A | * | 8/1989 | Yunoki | 83/110 |
| 5,079,980 | A | * | 1/1992 | Oakes et al. | 83/236 |
| 5,911,807 | A | * | 6/1999 | Brooks et al. | 83/262 |
| 6,095,321 | A | * | 8/2000 | Striegl et al. | 198/847 |

FOREIGN PATENT DOCUMENTS

| | | | |
|---|---|---|---|
| CH | 633 230 | | 11/1982 |
| DE | 1502776 | * | 5/1969 |
| DE | 31 31 101 | | 4/1982 |
| DE | 19624277 A | * | 4/1997 |
| EP | 0 453 943 | | 10/1991 |

* cited by examiner

*Primary Examiner*—Allan N. Shoap
*Assistant Examiner*—Stephen Choi
(74) *Attorney, Agent, or Firm*—Flynn, Thiel, Boutell & Tanis, P.C.

(57) ABSTRACT

A device for cutting a paper web in a transverse direction includes a first continuously driven conveyor for moving the paper web through the device, a loop forming station, a cutting device, a clamping device for temporarily retaining the paper web, and a second conveyor for moving the paper web further after it is stored. The second conveyor includes a continuously driven transport roller and pressure rollers that are intermittently pressed onto the transport roller. The clamping device and the lifting device are driven in step with the cutting device so that the paper web is retained by the clamping device and the pressure rollers are lifted from the transport roller while the paper web is cut. The lifting device controls and lifts the pressure rollers of the second conveyor from the transport roller shortly before the paper web is stretched when the loop is undone.

11 Claims, 1 Drawing Sheet

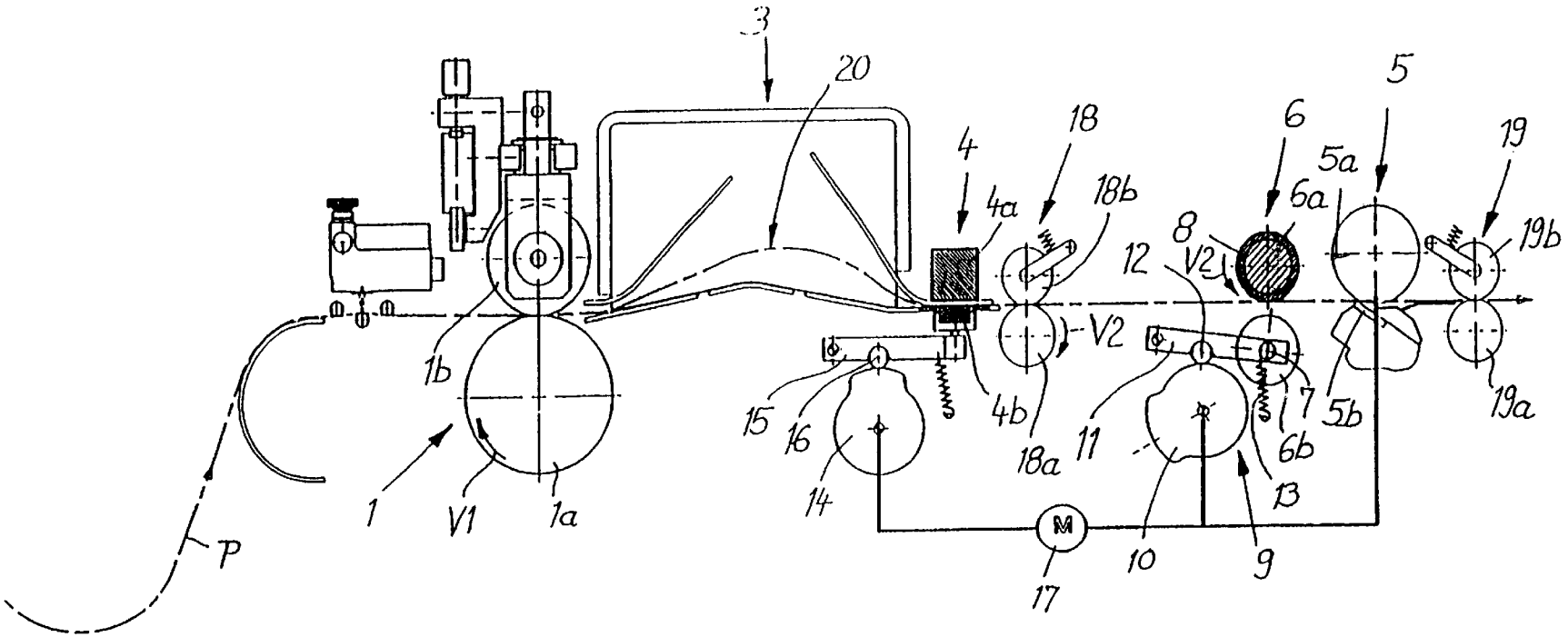
19
19b
19a
5
5a
5b
6
6a
6b
7
13
9
8
V2
12
10
11
18
18b
V2
18a
17
M
4
4a
4b
20
3
14
16
15
1a
1b
V1
1
P

DEVICE FOR CUTTING A PAPER WEB IN THE TRANSVERSE DIRECTION

The invention relates to a device for cutting a paper web in a transverse direction, comprising a continuously driven first conveyor, by means of which the paper web is moved at a constant first conveying speed into the device and is there stored in the form of a loop during the cutting operation, comprising a stationarily arranged cutting device, comprising a clamping device for the intermittent clamping of the paper web, and comprising a second conveyor to move the paper web after its storage at a second conveying speed increased in comparison to the first conveying speed, consisting of a continuously driven transport roller and several pressure rollers which can be intermittently pressed on the transport roller with the interpositioning of the paper web by means of a lifting device, whereby the clamping device and the lifting device can be driven in step with the cutting device in such a manner that for the duration of the cutting operation, the paper web is clamped by the clamping device, and the pressure rollers are lifted off from the transport roller.

BACKGROUND OF THE INVENTION

The second conveyor is, in a conventional device for the transverse cutting of a paper web of this type (DE 31 31 101 A1), arranged in a feed direction of the paper web in front of the clamping device and the latter is placed directly in front of the cutting device. A joint crank drive is provided to operate the clamping device, the cutting device and the lifting device, which joint crank drive coordinates through three connecting rods the movements of the aforementioned devices in such a manner that for the duration of the cutting operation the paper web is clamped by the clamping device and the pressure rollers are lifted off from the transport roller. Since during the clamping of the paper web the first conveyor continuously runs and the second conveyor is inactive because of the lifted-off pressure rollers, a loop is formed in the area in front of the second conveyor. As soon as the cutting operation has ended, the pressure rollers are again pressed on the transport roller of the second conveyor and the paper web is moved on by said second conveyor at a conveying speed, which is increased relative to the first conveying speed, which first causes the loop to be undone and the paper web to be tightened. The paper web is subsequently moved on by the first conveyor and the second conveyor. The pressure rollers of the second conveyor are pressed by spring force on the transport roller, whereby this spring force is adjusted so weak that, with the paper web being tightened, slip occurs between the transport roller rotating at a high speed and the paper web. The conveying speed of the web is determined exclusively by the conveying speed of the first conveyor. In order for the mentioned slip between the transport roller of the second conveyor and the paper web to be able to occur, the second transport roller is designed as a metal roller. The maximum possible pulling force is hereby limited on the one hand in such a manner that no pressure points whatsoever may show in the paper web when the mentioned slip occurs, and on the other hand the paper web at the moment of the tightening of the same, when the loop has just been undone, may not tear. The second conveyor has thus a relatively small pulling force and therefore cannot sufficiently quickly accelerate the paper web from standstill, after it has been released from the clamping device, thus causing the cutting performance of this known device to be very limited. Furthermore, there also exists the danger of a paper jam. Namely, in order to achieve an as high as possible cutting performance, the pressure rollers of the second conveyor must, after the cutting operation has ended, be pressed as quickly as possible again on the transport roller. When at this time the clamping jaws of the clamping device are not yet completely opened, there exists the danger that the paper web gets caught on the partially open clamping jaws and a paper jam occurs. The pressure rollers can therefore only be pressed on the transport roller when the complete opening of the clamping device has been secured. This also results in limiting the cutting performance.

Another conventional device for the transverse cutting of a paper web (DE 196 24 277) has a design similar to the aforedescribed device, with the difference that the second conveyor is arranged between the clamping device and the cutting device, and that this second conveyor lacks a lifting device for lifting off the pressure rollers. The pressure rollers are in this conventional device continuously pressed by spring force on the continuously driven transport roller of the second conveyor. Since same is arranged in paper running direction behind the clamping device, however, the paper web is clamped by the clamping device during the cutting operation, a slip between the second conveyor and the paper web must be possible during the cutting operation. In order to accomplish this, the transport roller of the second conveyor is designed as a metal roller and the spring force acting on the pressure rollers is adjusted relatively low. The maximum possible pulling force of the second conveyor is here also limited in such a manner that no pressure points whatsoever may show in the paper web when the mentioned slip occurs and the paper web, at the moment of a tightening of the same, when the loop has just been undone, may not tear. Thus the second conveyor has here also a relatively small pulling force and can therefore not sufficiently quickly accelerate the paper web from standstill, after it has been released from the clamping device. The cutting performance also of this conventional device is limited in this manner at a form length of approximately 9 cm to 50,000 cuts per hour.

The basic purpose of the invention is therefore to provide a device for the transverse cutting of a paper web of the above-identified type, which most of all enables a significant increase in the cutting performance.

SUMMARY OF THE INVENTION

This is attained according to the invention in such a manner that the second conveyor is arranged between the clamping device and the cutting device, that the transport roller of the second conveyor has a surface coating with an as large as possible coefficient of friction relative to the paper web, and that the lifting device is designed such or can be controlled such that the pressure rollers are lifted off from the transport roller just prior to the paper web being tightened through a taking up of the loop.

The pressure rollers of the second conveyor can in this new device for the transverse cutting of a paper web be pressed immediately following the end of the cutting operation again on the transport roller of the second conveyor. As soon as this has taken place, the initially resting paper web is much accelerated by the transport roller. This high acceleration is possible because the surface coating of the transport roller has a high coefficient of friction relative to the paper web and can therefore transmit a high pulling force to same. The paper web can be accelerated already at a time, at which the clamping device is only partially open since the second conveyor is arranged behind the clamping device and therefore pulls the paper web through the clamping device.

The danger of a paper jam at the clamping device is thus eliminated. It is also important that the pressure rollers are again lifted off from the transport roller by the lifting device shortly before the paper loop is undone and the paper web is tightened. Otherwise the paper web would namely tear due to the high acceleration of the paper web and the high pulling force of the transport roller. As a whole the time needed for an undoing of the loop is significantly shortened by the high acceleration of the paper web, which in particular in the case of short form lengths results in a significant increase of the cutting performance. Thus it is, for example, possible at a form length of 10 cm to achieve a cutting performance of up to 100,000 cuts per hour or more than 27 cuts per second. This means that within a time period of only 0.036 seconds the paper web is accelerated from standstill after the end of a cutting operation, is moved 10 cm by the second conveyor, is clamped by means of a clamping device, and is cut by the cutting device. At a form length of approximately 30 cm, the new device makes it still possible to reach a cutting performance of up to approximately 36,000 cuts per hour.

BRIEF DESCRIPTION OF THE DRAWING

The drawing schematically illustrates one embodiment of the paper cutting device.

DETAILED DESCRIPTION OF THE INVENTION

The paper web P is continuously fed to the device for the transverse cutting by means of a first conveyor 1 consisting of a driven transport roller 1*a* and a pressure roller 1*b*. The transport roller 1*a* is continuously driven with a first peripheral speed V1 and gives the paper web a conveying speed V1, which corresponds, for example, to the delivery speed of a not illustrated laser printer connected in front thereof. The first conveyor can also be a so called tractor consisting of two conveyor belts arranged parallel to one another and engaging with their points the perforations in the longitudinal edges of the paper web. A loop-forming station 3 follows the first conveyor 1, the function of which will be discussed in greater detail later on in connection with the description of the operation of the device. The loop-forming station 3 is followed by a clamping device 4, consisting of at least one stationary clamping jaw 4*a* and a movable clamping jaw 4*b*. A second conveyor 6 is provided between the clamping device 4 and a cutting device 5. The cutting device 5 is preferably a cutting device with a rotating knife 5*a*, which cooperates with a stationary knife 5*b*. However, it is also possible to provide a cutting device with one up and down movable knife and one stationary knife.

The second conveyor device 6 consists of a continuously driven transport roller 6*a* and several pressure rollers 6*b*, which can be pressed on the transport roller with the interpositioning of the paper web P. The pressure rollers 6*b* are arranged spaced apart on a common axle 7. The transport roller 6*a* has a surface coating or a layer 8, which has an as large as possible coefficient of friction relative to the paper web P. The surface coating 8 consists preferably of a rubber-elastic material, in particular of polyurethane elastomer on the basis of naphthalin-1,5-diyldiisocyanate (known under the registered Trademark Vulkollan).

The pressure rollers 6*b* can according to the invention be pressed intermittently on the transport roller 6*a* with the interpositioning of the paper web P. A lifting device 9 is provided for this purpose. Same consists of a rotatable cam plate 10 and a rocker arm 11, on the free end of which is arranged the axle 7. The rocker arm 11 is supported through a support roller 12 on the cam plate 10. A spring 13 assures that the support roller 12 is always held on the cam plate 10. The movable clamping jaw 4*b* of the clamping device 4 is driven in a similar manner through a cam plate 14, a rocker arm 15 and a support roller 16.

The cam plates 10 and 14 and the rotating cutting knives 5*a* are driven by a common motor 17, which causes the drive of the lifting device 9 and of the clamping device 4 to occur in step with the cutting device 5.

A third conveyor 18 is advantageously additionally provided between the clamping device 4 and the cutting device 5, which conveyor 18 is advantageously arranged adjacent to the clamping device 4, whereas the second conveyor 6 is provided adjacent to the cutting device 5. The third conveyor 18 consists of a continuously driven transport roller 18*a* and several pressure rollers 18*b* pressed on the transport rollers by springs. The transport roller 18*a* has a metal surface. The bearing pressure, with which the pressure rollers 18*b* are pressed on the transport roller 18*a* with the interpositioning of the paper web P, is chosen in such a manner that the transport roller 18*a* can continue to rotate even when the paper web is clamped in without leaving pressure points in the paper web.

The two transport rollers 6*a* and 18*a* are driven continuously with a peripheral speed V2, which is higher than the peripheral speed V1 of the first conveyor 1.

A fourth conveyor 19, also consisting of a continuously driven transport roller 19*a* and several pressure rollers 19*b*, which can be resiliently pressed on the roller 19*a* with the interpositioning of the paper web P, is provided behind the cutting device 5. The peripheral speed V2 of the transport roller 19*a* corresponds with the peripheral speed of the transport rollers 6*a* and 18*a*.

The so far described device operates as follows:

The paper web P is moved at a constant speed by the first conveyor into the device of the invention for the transverse cutting. The paper web is then cyclically clamped by the clamping device 4 while the cutting device 5 carries out the cutting operation. While the paper web is clamped by the clamping device 4, the paper web P is continuously moved on by the first conveyor 1, and the amount of paper moved thereby is stored in the form of a loop 20 in the loop forming station 3. While the paper web is clamped by the clamping device 4, the transport roller 18*a* of the third conveyor 18 rotates while slidingly engaging the paper web, whereby, however, the pressure rollers 6*b* of the second conveyor 6 are lifted off from the transport roller 6*a*, and the transport roller 6*a* does not apply any transporting action to the paper web. The paper cut off by the cutting device 5 is moved on by the fourth conveyor 19. After the cutting operation has been carried out, the clamping device 4 is released by the cam plate 14 and the pressure rollers 6*b* are at the same time pressed on the transport roller 6*a* by the cam plate 10. Due to the high coefficient of friction of the surface coating 8 the transport roller 6*a* applies a high pulling force to the paper web P and speeds the paper web up in the shortest time to an increased conveying speed, which corresponds with the peripheral speed V2 of the transport roller 6*a* and also of the transport roller 18. Since the peripheral speed V2 is greater than the conveying speed V1 of the first conveyor 1 the paper loop 20 formed during the clamping of the paper web is undone. Just before the paper loop is undone and the paper web is tightened, the pressure rollers 6*b* must again be lifted from the transport roller 6*a* since the paper web would otherwise tear. The on-time lifting of the pressure rollers 6*b* is done by a suitable design of the cam plate 10. The paper web is, with the pressure rollers 6*b* being lifted, moved on by the third conveyor 18 and in the case of larger form lengths also by the fourth conveyor 19 until the predetermined form length has been reached. The paper web is subsequently again clamped by means of the clamping device 4 and the cutting is done by means of cutting device 5. Through the intermittently acting transport roller 6*a* with a surface coating 8 with a high coefficient of friction relative to the paper web, the paper web is accelerated within the shortest time, thus significantly shortening the duration of a taking up of the loop 20, in particular in the case of short form lengths. This results in a significant increase in the performance of the entire device.

The cam plates 10, 14 illustrated in the drawing can also have an outwardly limited control cam in the form of a groove, into which the rollers 12 or 16 engage from the side. An automatic control of the rollers 12 or 16 upwardly and downwardly is achieved in this manner and the spring 13 can be eliminated.

What is claimed is:

1. A device for the transverse cutting of a paper web, comprising:

a first continuously driven conveyor for moving the paper web at a first constant conveying speed into the device;

a loop-forming station in the form of a loop for storing the paper web during a cutting operation;

a clamping device arranged in a paper-running direction from the loop-forming station for intermittent clamping of the paper web;

a second conveyor provided in the paper-running direction from the clamping device to move the paper web on after being stored by the loop-forming station at a second conveying speed greater than the first conveying speed, the second conveyor comprising a continuously driven transport roller and several pressure rollers for intermittently pressing on said transport roller;

a lifting device for interpositioning of the paper web by lifting the pressure rollers; and a cutting device stationarily arranged in the paper-running direction from the second conveyor, wherein the clamping device and the lifting device are driven in step with the cutting device so that, for the duration of the cutting operation, the paper web is closed by the clamping device and the pressure rollers are lifted from the transport roller, wherein the transport roller of the second conveyor includes a surface coating of a rubber-elastic material, and the lifting device is controlled so that the pressure rollers are lifted off from the transport roller before the loop is undone and the paper web is tightened.

2. The device according to claim 1, wherein the surface coating consists of polyurethane-elastomer on the basis of naphthalin-1,5-diyldiisocynate.

3. The device according to claim 1, wherein the lifting device includes a cam gear.

4. The device according to claim 1, wherein a third conveyor is arranged between the clamping device and the cutting device, the third conveyor comprising a continuously driven transport roller and several pressure rollers for resilient pressing on said transport roller, so that said transport roller is driven at the same peripheral speed as the transport roller of the second conveyor.

5. The device according to claim 4, wherein the second conveyor is arranged adjacent to the cutting device and the third conveyor is arranged adjacent to the clamping device.

6. The device according to claim 4, wherein the transport roller of the third conveyor includes a metal surface.

7. A device for transverse cutting of a web comprising:

a first conveyor for moving the web along a path of travel at a first conveying speed;

a loop-forming station arranged downstream along the path of travel of the web from said first conveyor for storing the web as a loop during a clamping and cutting operation;

a clamping device arranged downstream from said loop-forming station along the path of travel of the web for periodic clamping of the web;

a second conveyor provided downstream from said clamping device to move the web, after being stored by said loop-forming station, at a second conveying speed which is greater than the first speed, said second conveyor comprising a continuously driven transport roller and pressure rollers;

a lifting device for periodically pressing said pressure rollers on said transport roller of said second conveyor to enable moving of the web; and a cutting device arranged downstream from said second conveyor for cutting the web, wherein said lifting device removes said pressure rollers of said second conveyor from contact with said transport roller just prior to the loop being undone and the web being tightened.

8. The device according to claim 7, wherein said continuously driven transport roller of said second conveyor includes a surface coating having a high coefficient of friction relative to the web, said high coefficient of friction of the surface coating enabling sudden acceleration of the web when said lifting device moves said pressure rollers into contact with the surface coating of said transport roller.

9. The device according to claim 8, wherein the surface coating comprises a rubber-elastic material.

10. The device according to claim 7, including a third conveyor arranged between said clamping device and said cutting device and comprising a continuously driven transport roller and pressure rollers, said transport roller of said third conveyor operating at the same peripheral speed as said transport roller of said second conveyor.

11. A device for transverse cutting of a web comprising:

a first conveyor for continuously moving the web along a path of travel at a first conveying speed;

a loop-forming station arranged downstream along the path of travel of the web from said first conveyor for storing the web in a loop during a cutting operation;

a clamping device arranged downstream from said loop-forming station along the path of travel of the web for periodic clamping of the web;

a second conveyor including a driven transport roller and pressure rollers provided downstream from said clamping device to drive the web, after being stored by said loop-forming station, at a second conveying speed which is greater than the first speed;

a lifting device for removing said pressure rollers of said second conveyor from contact with said transport roller just prior to the web being tightened while the web is clamped; and a cutting device arranged downstream from said second conveyor for cutting the web, wherein, in operation, said second conveyor is removed from driving the web just prior to the web being cyclically clamped by said clamping device while said cutting device cuts the web, and after cutting by the cutting device ends, said clamping device is released and said second conveyor applies a pulling force to the web and accelerates the web to the second conveying speed.

* * * * *